US005184689A

United States Patent [19]

Sheirer et al.

[11] Patent Number: 5,184,689

[45] Date of Patent: Feb. 9, 1993

[54] RADIAL CUT DRILL BIT INSERT

[75] Inventors: Daniel C. Sheirer; Gerald L. Woods, both of Bedford; Robert H. Montgomery, Jr., Everett, all of Pa.

[73] Assignee: Kennametal Inc., Latrobe, Pa.

[21] Appl. No.: 665,501

[22] Filed: Mar. 6, 1991

[51] Int. Cl.[5] ..... E21B 10/44

[52] U.S. Cl. ..... 175/420.1; 408/211

[58] Field of Search ..... 175/420.1, 421, 426; 51/288; 408/220-222, 227-230, 233, 217, 199, 713

[56] References Cited

U.S. PATENT DOCUMENTS

| | | | |
|---|---|---|---|
| 603,748 | 5/1898 | Thau | 408/233 |
| 984,323 | 2/1911 | Vauclain | 408/228 |
| 2,903,921 | 9/1959 | Andreasson | 408/230 X |
| 3,199,381 | 8/1965 | Mackey | 408/230 X |
| 3,667,857 | 6/1972 | Shaner et al. | 408/230 |
| 4,120,601 | 10/1978 | Benjamin | 408/228 X |
| 4,342,368 | 8/1982 | Denman | 175/410 |
| 4,489,796 | 12/1984 | Sanchez et al. | 175/410 |
| 4,527,638 | 7/1985 | Sanchez et al. | 175/57 |
| 4,688,972 | 8/1987 | Kubota | 408/230 |
| 4,787,464 | 11/1988 | Ojanen | 175/57 |
| 4,826,364 | 5/1989 | Grunsky | 408/230 X |
| 5,094,572 | 3/1992 | Alsbury et al. | 408/228 X |

*Primary Examiner*—Ramon S. Britts
*Assistant Examiner*—Roger J. Schoeppel
*Attorney, Agent, or Firm*—Larry R. Meenan; John J. Prizzi

[57] ABSTRACT

An insert for use in a rotary drill bit wherein first and second top surfaces are opposite a bottom surface, first and second leading faces are opposite first and second trailing faces, and first and second end faces represent outside edges of first and second portions of the insert wherein in one embodiment each of the top surfaces meets its respective leading face to form a cutting edge which forms an oblique angle wherein the cutting edge on the first portion is linearly aligned with the cutting edge on the second portion.

22 Claims, 3 Drawing Sheets

RADIAL CUT DRILL BIT INSERT

BACKGROUND OF THE INVENTION

1. Field of the Invention

The present invention relates to a hard wear resistant insert. More particularly, the present invention relates to a hard wear resistant insert finding application in a rotary drill bit and a method of use.

2. Description of the Related Art

A rotary drill bit is typically attached to a working end of an elongated, hollow drill rod having an opposing end connected to a source of rotary and thrust power. By the action of the source of rotary and thrust power, the rotary drill bit may be used for drilling holes in a work surface such as a rock strata in the roof of a mine entry for installing roof bolts or receiving explosive charges. The rotary drill bit which is secured to the working end of the drill rod includes a body having a top working surface to which is attached at least one insert made of a hard wear resistant material.

The hard wear resistant material of the insert may consist in whole or in part of cemented tungsten carbide. Examples of various inserts which may be formed of cemented tungsten carbide may be found in U.S. Pat. Nos. 4,489,796; 4,527,638; 4,342,368; and 4,787,464. The tungsten carbide which forms the insert is a relatively expensive material and represents a substantial portion of the overall cost of the insert. In view of the expense of tungsten carbide material there is a significant need for an improved rotary drill bit insert having a reduced amount of cemented tungsten carbide material yet is effective in the drilling of a work surface.

Accordingly, one aspect of the present invention is to provide an improved insert geometry for application in a rotary drill bit which utilizes a reduced amount of cemented tungsten carbide material and a method of use of the rotary drill bit. Another aspect of the present invention is to provide an insert which utilizes a reduced amount of cemented tungsten carbide material that may be simply and economically manufactured.

SUMMARY OF THE INVENTION

Briefly, according to this invention, there is provided a rotary drill bit including an insert having an elongated body rotatable and symmetrical about a central axis.

The body of the insert includes a first top surface, a second top surface, a bottom surface opposite the first and second top surface, a first leading face extending between forwardly facing edges of the first top surface and the bottom surface, a second leading face extending between forwardly facing edges of the second top surface and the bottom surface. A first trailing face is positioned opposite the first leading face and extends between rearwardly facing edges of the first top surface and the bottom surface and a second trailing face is positioned opposite the second leading face and extends between rearwardly facing edges of the second top surface and the bottom surface. A first end surface extends between outwardly facing edges of the first top surface, bottom surface, first leading face and first trailing face and a second end surface extends between outwardly facing edges of the second top surface, bottom surface, second leading face and second trailing face.

A top edge is defined by the intersection of the first top surface and the second top surface and a first cutting edge is defined by the intersection of the first top surface and the first leading face and a second cutting edge is defined by the intersection of the second top surface and the second leading face.

Oblique angles are formed in a plane normal to the central axis by the intersection of a plane containing the first leading face and a plane containing the first trailing face and by the intersection of a plane containing the second leading face and a plane containing the second trailing face wherein each plane containing the first and second trailing faces are parallel and staggered.

The first leading face is coterminous with the second trailing face and the second leading face is coterminous with the first trailing face. The first leading face and the second leading face include an incurvate portion adjacent the coterminous first trailing face and the second trailing face. In a preferred embodiment the incurvate portion has a radius of approximately ⅛ of an inch.

The first cutting edge of the insert is linearly aligned with the second cutting edge.

The insert includes a top edge formed by the intersection of the first top surface and the second top surface. A trailing edge is also defined by the intersection of the first trailing face and the first top surface and by the intersection of the second trailing face and the second top surface and an outer edge is defined by the intersection of the first end surface and the first top surface, bottom surface, first leading face and first trailing face and the intersection of the second end surface and the second top surface, bottom surface, second leading face and second trailing face. The first and second end surfaces may be tapered from the leading face toward the trailing face.

The first and second top surfaces are generally polygonal in shape such that the first top surface extends from the first cutting edge to the trailing edge and the second top surface extends from the second cutting edge to the trailing edge.

In one embodiment of the present invention, the first and second top surfaces include a substantially planar surface contiguous a transition surface. The planar surface is inclined at a constant angle of inclination with respect to a first radial line projecting from the central axis and inclined at a constant angle of inclination with respect to a second line normal to the radial line. The angle of inclination of the planar surface with respect to the second line is approximately 24 degrees.

In yet another embodiment of the present invention, the first and second top surfaces each include a front surface contiguous a noncoplanar back relief surface. The front surface is inclined at a constant angle of inclination with respect to a first radial line projecting from the central axis and inclined at a constant angle of inclination with respect to a second line normal to the radial line. The angle of inclination of the front surface with respect to the second line is between about 15 to 55 degrees and preferably approximately 24 degrees.

The back relief surface is rounded along the radial length thereof from the clearance edge to the trailing edge to form a concave back relief surface. The top edge of the insert is concave. The front surface and the back relief surface intersect to form a clearance edge, the clearance edge extending radially from the top edge to the outer edge. The back relief surface is inclined with radial distance from the central axis at a variable angle of inclination with respect to the second line.

The present invention may be used in a rotary drill bit comprising a cylindrical body including two opposing dust collection openings and a top working surface to which is attached the insert.

In accordance with another aspect of the present invention, a new and improved method of drilling a hole in a work surface is provided. The new and improved method comprises positioning a drill bit including an insert according to the present invention, rotating the drill bit from about 200 to about 1000 rpm, applying a thrust to the drill bit from about 1000 to about 8000 lbs and drilling a hole in a work surface.

BRIEF DESCRIPTION OF THE DRAWINGS

Further features and other aspects of this invention will become clear from the following detailed description made with reference to the drawings in which.

DESCRIPTION OF THE PREFERRED EMBODIMENTS

Figure 1:
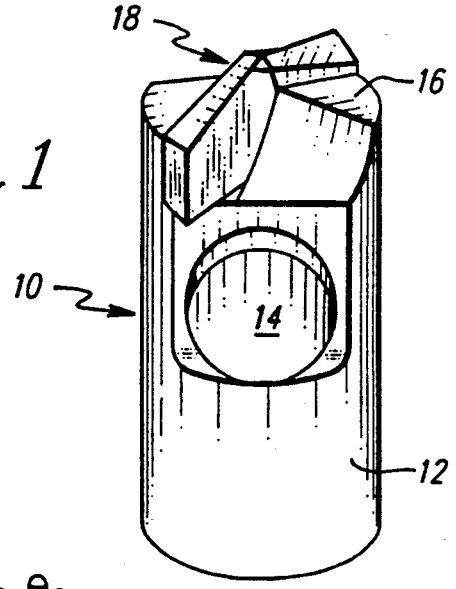
FIG. 1 is perspective view of an insert in accordance with the present invention secured within a rotary drill bit.

In the following description, like reference characters designate like or corresponding parts. Also, in the following description, it is to be understood that such terms as "front," "back," "top," "bottom," "outer," "forwardly," "rearwardly," and the like, are words of convenience and are not to be construed as limiting terms.

Although the invention is described in connection with a standard 1 inch by 0.18 inch rotary drill bit insert, it will be readily apparent that the present invention may be used with equal facility in other size rotary drill bit inserts and therefore the description of the invention in relation to a 1 inch insert is not to be construed as a limitation on the scope of the invention.

Referring now to FIG. 1, there is shown a rotary drill bit 10. The rotary drill bit 10 includes a cylindrical body 12 having two opposing dust collection openings 14 and a top working surface 16 to which is attached an insert 18 made of a hard wear resistant material. The insert 18 of the rotary drill bit 10 includes a generally elongated body symmetrical and rotatable about a central axis 20. The body of the insert 18 includes a first and second top surface 22 and 24, a bottom surface 26, a first and second leading face 28 and 30, a first and second trailing face 32 and 34 and a first and second end surface 36 and 38.

Figure 3:
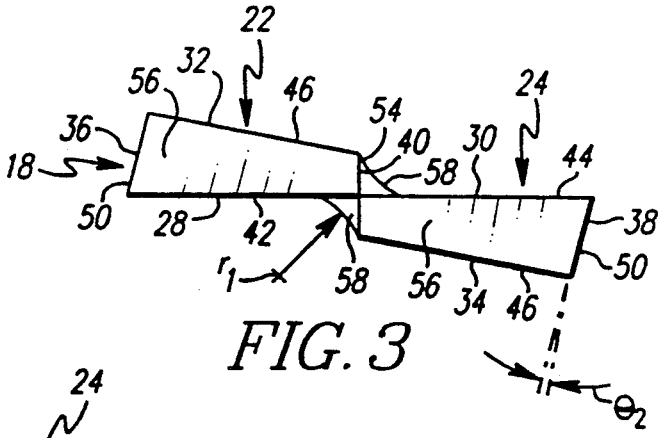
FIG. 3 is a top view of the insert of FIG. 2.
Figure 6:
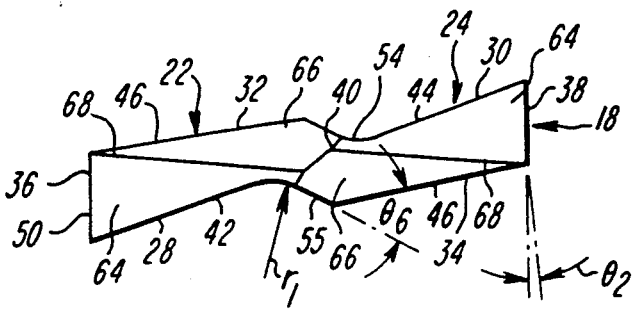
FIG. 6 is a top view of the insert of FIG. 5.

A top edge 40 is formed by the intersection of the first top surface 22 and the second top surface 24. A first cutting edge 42 and a second cutting edge 44 are defined by the intersection of the first top surface 22 and the first leading face 28 and by the intersection of the second top surface 24 and the second leading face 30, respectively. As shown in FIGS. 3 and 6 the first cutting edge 42 is linearly aligned with the second cutting edge 44. Similarly, at the intersection of the first trailing face 32 and the first top surface 22 and at the intersection of the second top surface 24 and the second trailing face 34 is a trailing edge 46. Outer edges 50 are formed by the intersection of the first end surface 36 and the first top surface 22, bottom surface 26, first leading face 28 and first trailing face 32 and the intersection of the second end surface 38 and the second top surface 24, bottom surface 26, second leading face 30 and second trailing face 34, respectively. The outer edge 50 at the intersection of the leading face 28 and end surface 36 and intersection of leading face 30 and end surface 38 may be rounded or radiused as described in U.S. Pat. No. 4,489,796.

First and second leading faces 28 and 30 are generally planar surfaces and extend between forwardly facing edges of the first top surface 22 and the bottom surface 26 and between forwardly facing edges of the second top surface 24 and the bottom surface 26, respectively. The first leading face 28 is coterminous with the second trailing face 34 and the second leading face 30 is coterminous with the first trailing face 32.

As shown in FIGS. 2, 3, 5, 6 and 9 the first and second leading faces 28 and 30 may include an incurvate portion 54 and/or a straight portion 55 adjacent the coterminous first and second trailing faces 32 and 34, respectively. The straight portion 55, as shown in FIG. 6, extends inwardly from the respective trailing face at an angle $\theta_6$ of approximately 35 degrees toward the incurvate portion 54. The radius $r_1$ of the incurvate portion 54 may be adjusted from about $\frac{1}{4}$ to 1/16 inch to vary the thickness of the insert 18 and the amount of tungsten carbide material required to form the insert yet provided sufficient strength to the insert. In a preferred embodiment the incurvate portion 54 has a radius $r_1$ of approximately $\frac{1}{8}$ of an inch.

The first and second leading faces 28 and 30 of the insert 18 may be parallel with or inclined at a constant angle $\theta_1$ with the central axis 20. This constant angle $\theta_1$ of inclination of the leading faces is preferably 0 degrees, however, the angle of inclination may range from 0–3 degrees such as that shown in U.S. Pat. No. 4,787,464 resulting in an insert thickness at bottom surface 26 less than or equal to the insert thickness at top surface.

The first trailing face 32 is positioned opposite the first leading face 28 and extends between rearwardly facing edges of the first top surface 22 and the bottom surface 26 and the second trailing face 34 is positioned opposite the second leading face 30 and extends between rearwardly facing edges of the second top surface 24 and the bottom surface 26. The first trailing face 32 and second trailing face 34 extend from the outer edge 50 to approximately the middle of the insert 18. A plane containing the first trailing face 32 and a plane containing the second trailing face 34 are parallel and staggered. Each trailing face 32 and 34, and optionally part or all of the leading faces 28 and 30, may meet bottom surface 26 at beveled or rabbeted edges. These rabbeted edges may be provided to aid conformation of the insert 18 within a slot formed within the drill bit 10.

As shown in FIGS. 3 and 6, the first top surface 22 and second top surface 24 are reverse images and are separated by the top edge 40. The first and second top surfaces 22 and 24 are generally polygonal in shape extending from the first and second cutting edges 42 and 44 to the trailing edge 46. The intersection of the first cutting edge 42 and the second cutting edge 44 forms an included angle $\theta_5$ of approximately 120–160 degrees, preferably 140 degrees.

Figure 2:
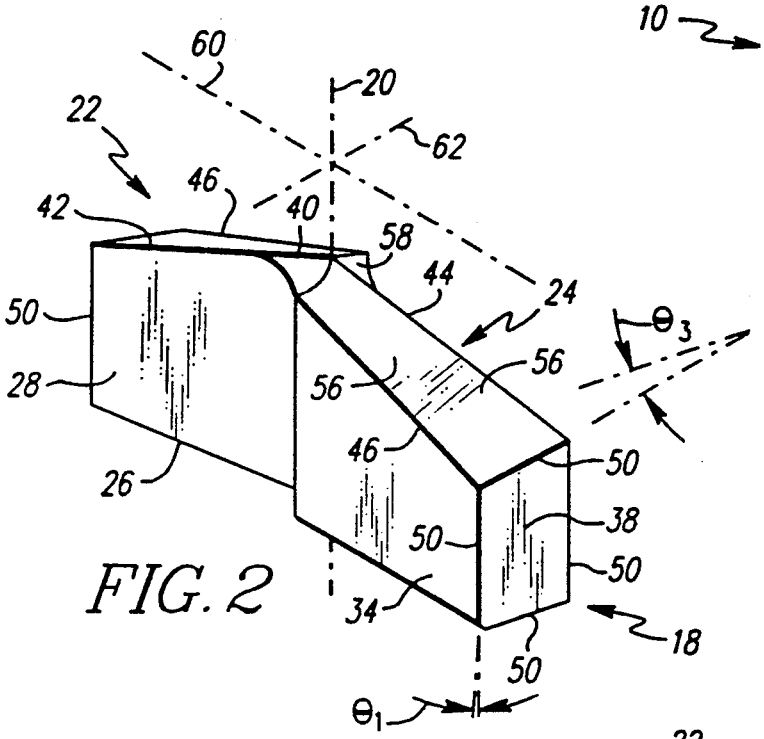
FIG. 2 is an isometric view of an insert in accordance with the present invention.
Figure 4:
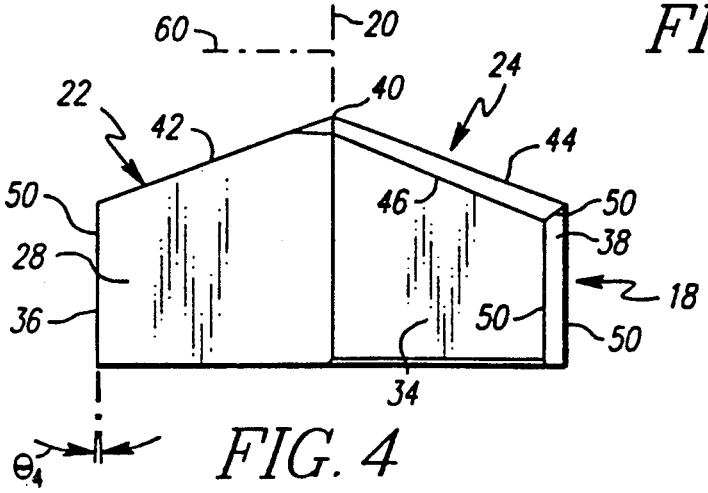
FIG. 4 is a front view of the insert of FIG. 2.
Figure 5:
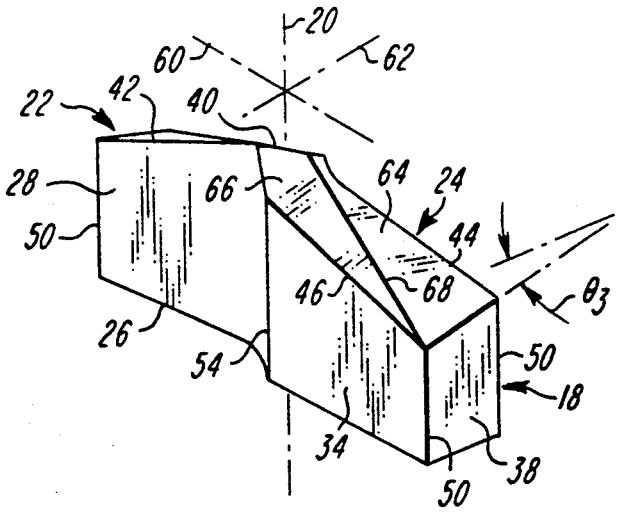
FIG. 5 is an isometric view of an insert in accordance with the present invention.

In one embodiment of the present invention as shown in FIGS. 2–4, the first and second top surfaces 22 and 24 of the insert 18 may each include a substantially planar surface 56 contiguous a transition surface 58. The planar surface 56 and transition surface 58 are typically polygonal in shape and extend from the cutting edge 42 to the trailing edge 46 between the top edge 40 and the outer edge 50.

The relief angle $\theta_3$ of the planar surface 56 is inclined at a constant angle of inclination with respect to a first radial line 60 projecting from the central axis 20 and inclined at a constant angle of inclination with respect to a second line 62 normal to the radial line. The relief angle $\theta_3$ of the planar surface 56 with respect to the second line 62 at all points along the cutting edge is between about 15–55 degrees, preferably 20–35 degrees and most preferably 24 degrees. The constant relief angle $\theta_3$ of inclination of the planar surface 56 with respect to the first radial line 60 is approximately 20 degrees. It will be appreciated that the relief angle $\theta_3$ of the planar surface 56 may also be varied such as that shown in U.S. Pat. No. 4,787,464.

In yet another embodiment of the present invention as shown in FIGS. 5–10, the first and second top surfaces 22 and 24 may each include a front surface 64 contiguous a noncoplanar back relief surface 66. The front surface 64 is typically polygonal in shape and extends from the cutting edge 42 to a clearance edge 68 formed by the intersection of the front surface and back relief surface 66 between the top edge 40 and the outer edge 50.

The relief angle $\theta_3$ of the front surface 64 is inclined at a constant angle of inclination with respect to a first radial line 60 projecting from the central axis 20 and inclined at a constant angle of inclination with respect to a second line 62 normal to the radial line. The relief angle $\theta_3$ of the front surface 64 with respect to the second line 62 at all points along the cutting edge 42 is between about 15–55 degrees, preferably 20–35 degrees and most preferably 24 degrees. The constant relief angle $\theta_3$ of inclination of the front surface 64 with respect to the first radial line 60 is approximately 20 degrees. It will be appreciated that the relief angle $\theta_3$ of the front surface 64 may also be varied such as that shown in U.S. Pat. No. 4,787,464.

Figure 10:
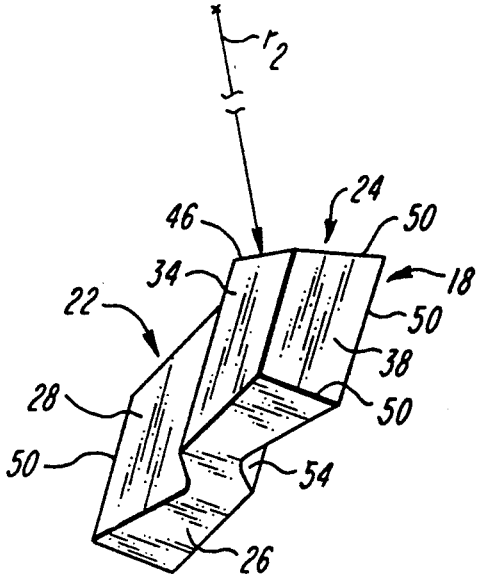
FIG. 10 is an auxiliary view of the insert of FIG. 5 illustrating a radiused back relief surface.

The back relief surface 66 is also polygonal in shape and extends forwardly from the trailing edge 46 to the clearance edge 68 between the top edge 40 and the outer edge 50. The back relief surface 66 may be planar, or as shown in FIG. 10, the back relief surface along the radial length thereof may be rounded or radiused from the clearance edge 68 to the trailing edge 46 to form a concave back relief surface. The radius $r_2$ of the back relief surface may vary from approximately ½ inch to 1 inch depending on the type of work surface to be drilled. For example, in a soft work surface, such as soft shale, the radius $r_2$ may be reduced to approximately ½ inch. The plane formed between the clearance edge 68, trailing edge 46 and those portions of the outer edge 50 and top edge 40 bordering the back relief surface is inclined at an angle with respect to the second line 62 which is at least equal to or greater than the corresponding relief angle $\theta_3$ of inclination of the front surface 64. The angle of inclination of the plane formed by the clearance edge 68, trailing edge 46, and those portions of the outer edge 50 and top edge 40 bordering the rounded back relief surface 66, may vary with radial distance from the central portion of the insert 18. The angle of inclination of the back relief surface 66 may be changed by varying the radius $r_2$ of the circular back relief surface and/or changing the position of the clearance edge 68.

Figure 7:
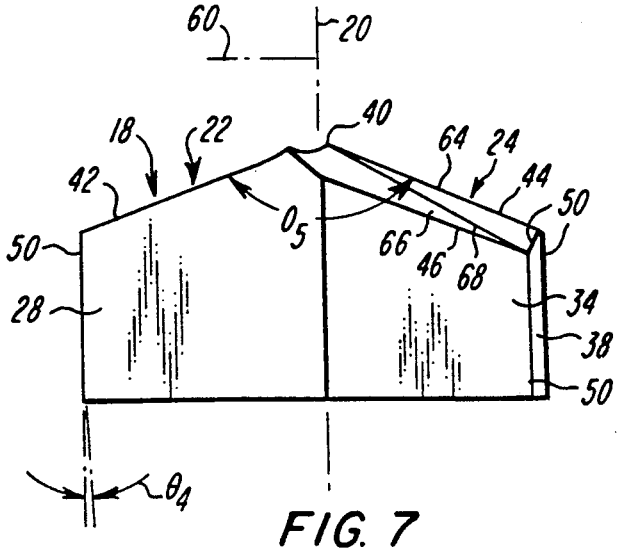
FIG. 7 is a front view of the insert of FIG. 5.
Figure 8:
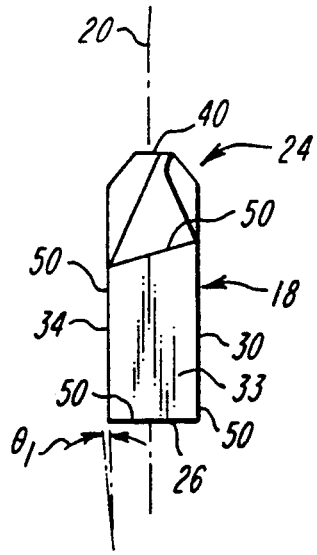
FIG. 8 is an end view of the insert of FIG. 5.
Figure 9:
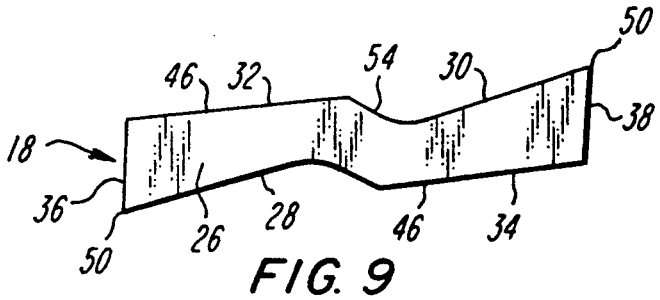
FIG. 9 is a bottom View of the insert of FIGS. 2 and 5.

It will be appreciated that as result of a rounded back relief surface 66 the top edge 40 formed by the adjoining rounded back relief surfaces of each top surface of the insert 18 is also concave, FIG. 7. The concave top edge 40 provides a penetration tip at the intersection of the top edge 40 and cutting edge 42 of the insert 18 to assist in the alignment of the insert and penetration of the insert into a work surface during the initial stages of the drilling operation.

The bottom surface 26 is positioned opposite the first and second top surface 22 and 24. The bottom surface 26 of the insert 18 is of a substantially flat planar form and extends between the lowermost edges of the first and second leading faces 28 and 30, first and second trailing faces 32 and 34 and the first and second end surface 36 and 38. The bottom surface 26 and first and second trailing face 32 and 34 provide a suitable surface for brazing of the insert 18 within a slot formed within the rotating drill bit 10 as is well known in the art.

Extending between the outer edges 50 of the first top surface 22, bottom surface 26, first trailing face 32 and first leading face 28 and between the outer edges 50 of the second top surface 24, bottom surface 26, second trailing face 34 and second leading face 30 are the first and second end surfaces 36 and 38, respectively. The end surfaces 36 and 38 are tapered inwardly toward the respective trailing faces thereby providing a relief angle $\theta_2$ for the end surfaces. As shown in FIGS. 3 and 6, the relief angle $\theta_2$ is preferably about 5 degrees with respect to a plane normal to the respective trailing face. As previously described, the end surfaces 36 and 38 of the insert 18 may also be tapered with respect to the central axis 20 thereby narrowing the insert at the bottom surface 26. Preferably, the tapered angle $\theta_4$ of the end surfaces is approximately 0–2 degrees with respect to the central axis 20.

The insert 18 in accordance with the present invention may be comprised of a composite material, the components of which may be uniformly distributed throughout the insert or alternatively, the ratio of the components may vary from one region to another within the insert, such as from the insert surface to the insert core. A preferred material for the insert 18 is a cemented tungsten carbide containing about 5–15 wt % cobalt as a binder, optionally with other refractory materials, such as cubic refractory transition metal carbides, as additives. The grain size of the tungsten carbide may vary from fine (e.g. about 1 micron), providing a harder insert, to coarse (e.g. about 12 micron), providing a tougher insert, depending on the intended use, the carbide to binder ratio, and the degree of fracture toughness desired. The inserts according to the invention may be utilized in various mine tool equipment according to the methods commonly accepted. Normally, the drill bit 10 containing the insert 18 will be fastened to a standard drill rod, which will be positioned to drill a hole in a work surface, and the bit 10 will be rotated at about 250–600 rpm and about 1000–10,000 lb thrust for a time sufficient to drill the desired hole in the work surface.

Illustrative of one aspect of the present invention, a 1 inch by 0.18 inch insert of the type shown in FIGS. 5–10 having an $r_1$ of approximately $\frac{1}{8}$ inch, $r_2$ of approximately 1 inch, $\theta_1$ of approximately 0 degrees, $\theta_2$ of approximately 5 degrees, $\theta_3$ of approximately 24 degrees, $\theta_4$ of approximately 0 degrees, $\theta_5$ of approximately 140 degrees and $\theta_6$ of approximately 35 degrees will require about 18% less cemented tungsten carbide material than a 1 inch insert of a type found in either a KCV4 or HKCV3 center vacuum bit obtainable from Kennametal Inc.

The patents referred to herein are hereby incorporated by reference.

Having described presently preferred embodiments of the present invention, it is understood that the invention may be otherwise embodied within the scope of the following claims.

What is claimed is:

1. A rotary drill bit insert rotatable about a central axis comprising:

an elongated body having a first top surface, a second top surface, a bottom surface opposite said first and second top surface, a first leading face extending between forwardly facing edges of said first top surface and said bottom surface, a second leading face extending between forwardly facing edges of said second top surface and said bottom surface, a first trailing face opposite said first leading face and extending between rearwardly facing edges of said first top surface and said bottom surface, a second trailing face opposite said second leading face and extending between rearwardly facing edges of said second to surface and said bottom surface, first leading and first trailing face, a second end surface extending between outwardly facing edges of said second top surface, bottom surface, second leading face and second trailing face;

a top edge defined by the intersection of said first top surface and said second top surface;

a first cutting edge defined by the intersection of said first top surface and said first leading face and a second cutting edge defined by the intersection of said first top surface and said first leading face second cutting edge defined by the intersection of said first top surface and said first leading face and a second cutting edge defined by the intersection of said second top surface and said second leading face; and wherein oblique angles are formed on a plane normal to the central axis by the intersection of a plane containing said first leading face and a plane containing said first trailing face and by the intersection of a plane containing said second leading face and a plane containing said second trailing face, wherein said first cutting edge is linearly aligned with said second cutting edge and said first and second trailing face are parallel and staggered.

2. The insert as set forth in claim 1 wherein said first leading face is coterminous with said second trailing face and said second leading face is coterminous with said first trailing face.

3. The insert as set forth in claim 2 wherein said first leading face and said second leading face include an incurvate portion adjacent said coterminous first trailing face and said second trailing face.

4. The insert as set forth in claim 3 wherein said incurvate portion has a radius of approximately $\frac{1}{8}$ of an inch.

5. The insert as set forth in claim 3 wherein a top edge is formed by the intersection of said first top surface and said second top surface.

6. The insert as set forth in claim 5 wherein trailing edges are defined by the intersection of said first trailing face and said first top surface and by the intersection of said second trailing face and said second top surface and outer edges are formed by the intersection of said first end surface and said first top surface, bottom surface, first leading face and first trailing face and the intersection of said second end surface and said second top surface, bottom surface, second leading face and second trailing face.

7. The insert as set forth in claim 6 wherein said first and second end surfaces are tapered from said leading face toward said trailing face.

8. Said insert as set forth in claim 6 wherein said first and second top surfaces are generally polygonal in shape, said first top surface extending from said first cutting edge to said trailing edge and said second top surface extending from said second cutting edge to said trailing edge.

9. The insert as set forth in claim 8 wherein said first and second top surfaces include a substantially planar surface contiguous a transition surface.

10. The insert as set forth in claim 9 wherein said planar surface is inclined at a constant angle of inclination with respect to a first radial line projecting from said central axis and inclined at a constant angle of inclination with respect to a second line normal to said radial line.

11. The insert as set forth in claim 10 wherein said angle of inclination of said planar surface with respect to said second line is approximately 24 degrees.

12. The insert as set forth in claim 8 wherein said first and second top surfaces each include a front surface contiguous a noncoplanar back relief surface.

13. The insert as set forth in claim 12 wherein said front surface is inclined at a constant angle of inclination with respect to a first radial line projecting from said central axis and inclined at a constant angle of inclination with respect to a second line normal to said radial line.

14. The rotary drill bit insert as set forth in claim 13 wherein said angle of inclination of said front surface with respect to said second line is between about 15 to 55 degrees.

15. The rotary drill bit insert as set forth in claim 13 wherein said angle of inclination of said front surface with respect to said second line is approximately 24 degrees.

16. The insert as set forth in claim 12 wherein said back relief surface is rounded along the radial length thereof from said clearance edge to said trailing edge to form a concave back relief surface.

17. The insert as set forth in claim 16 wherein said top edge is concave.

18. The rotary drill bit as set forth in claim 17 wherein said front surface and said back relief surface intersect to form a clearance edge, said clearance edge extending radially from said top edge to said outer edge.

19. The rotary drill bit insert as set forth in claim 16 wherein said back relief surface is inclined with radial distance from said central axis at a variable angle of inclination with respect to said second line.

20. A rotary drill bit comprising a cylindrical body including two opposing dust collection openings and a top working surface having attached thereto an insert, said insert including an elongated boy having a first top surface, a second top surface, a bottom surface opposite said first and second top surface, a first leading face extending between forwardly facing edges of said first top surface of said bottom surface, a second leading face extending between forwardly facing edges of said second top surface sand said bottom surface, a first trailing face opposite said first leading face and extending between rearwardly facing edges of said first top surface and said bottom surface, a second trailing face opposite said second leading face and extending between rearwardly facing edges of said second top surface and said bottom surface, a first end surface extending between outwardly facing edges of said first top surface, bottom surface, first leading face and first trailing face, a second end surface extending between outwardly facing edges of said second top surface, bottom surface, second leading edge and second trailing face;

a top edge defined by the intersection of said first top surface and said second top surface;

a first cutting edge defined by the intersection of said first top surface and said first leading face and a second cutting edge defined by the intersection of second top surface and said second leading face; and wherein obliquely angles are formed on a plane normal to the central axis by the intersection of a plane containing said first leading face and a plane containing said first trailing face and by the intersection of a plane containing said second leading face and a plane containing said second trailing face wherein said first cutting edge is linearly aligned with said second cutting edge and said first and second trailing face are parallel and noncoplanar.

21. The rotary drill bit as set forth in claim 20 wherein said first leading face is coterminous with said second trailing face and said second leading face is coterminous with said first trailing face and wherein said first leading face and said second leading face include an incurvate portion adjacent said coterminous first trailing face and said second trailing face.

22. A method of drilling a hole in a work surface comprising the steps of:

positioning a mine tool including a rotary drill bit having a rotary drill bit insert including an elongated body having a first top surface, a second top surface, a bottom surface opposite said first and second top surface, a first leading face extending between forwardly facing edges of said first top surface and said bottom surface, a second leading face extending between forwardly facing edges of said second top surface and said bottom surface, a first trailing face opposite said first leading face and extending between rearwardly facing edges of said first top surface sand said bottom surface, a second trailing face opposite said second leading face and extending between rearwardly facing edges of said second top surface and said bottom surface, a first end surface extending between outwardly facing edges of said first top surface, bottom surface, first leading face and first trailing face, a second end surface extending between outwardly facing edges of said second top surface, bottom surface, second leading face and second trailing face;

a top edge defined by the intersection of said first top surface and said second top surface;

a first cutting edge defined by the intersection of said first top surface and said first leading face and a second cutting edge defined by the intersection of said second top surface and said second leading face; and wherein oblique angles are formed on a plane normal to the central axis by the intersection of a plane containing said first leading face and a plane containing said first trailing face and by the intersection of a plane containing said second leading face and a plane containing said second trailing face wherein said first cutting edge is linearly aligned with said second cutting edge and said first and second trailing face are parallel and noncoplanar; and rotating the rotary drill bit insert at about 250–600 rpm and about 1000–10,000 lbs thrust for a time sufficient to drill the hole in the work surface.

* * * * *